US006422295B1

(12) United States Patent
Larsson et al.

(10) Patent No.: US 6,422,295 B1
(45) Date of Patent: Jul. 23, 2002

(54) METHOD AND DEVICE FOR CHILL MOLDING

(75) Inventors: Bengt-Åke Larsson, Skövde; Bertil Sander, Nygård; Roland Carlsson; Sven-Erik Dahlberg, both of Skövde, all of (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/681,595

(22) Filed: May 3, 2001

Related U.S. Application Data

(63) Continuation of application No. PCT/SE99/02005, filed on Nov. 5, 1999.

(51) Int. Cl.[7] ..... B22D 15/04; B22D 27/04

(52) U.S. Cl. ..... 164/128; 164/348; 164/352

(58) Field of Search ..... 164/126, 127, 164/128, 348, 352, 353, 354, 355, 356

(56) References Cited

U.S. PATENT DOCUMENTS

| | | | | |
|---|---|---|---|---|
| 2,295,858 A | * | 9/1942 | Mcwane | 164/348 |
| 4,085,790 A | | 4/1978 | Wittmoser | |
| 5,744,173 A | | 4/1998 | Sterett | |

FOREIGN PATENT DOCUMENTS

| | | |
|---|---|---|
| SE | 435243 B | 9/1984 |
| WO | WO 9919099 A1 | 4/1999 |

* cited by examiner

*Primary Examiner*—Kuang Y. Lin
(74) *Attorney, Agent, or Firm*—Kilpatrick Stockton LLP

(57) ABSTRACT

Method and device for casting cast iron including a metal chill mold (100) having outer walls (206, 208, 210) and inner walls (212, 213, 220). The inner walls are in contact with a mold (300). The device further includes pressurizing means (400) for applying a variable pressure on the outer walls (206, 208, 210) of the chill mold, in order to control changes in volume of molten material enclosed by the chill mold, and chill mold cooling means (500) for variable cooling of the inner walls (212, 213, 220) of said chill mold.

17 Claims, 1 Drawing Sheet

METHOD AND DEVICE FOR CHILL MOLDING

CROSS REFERENCE TO RELATED APPLICATIONS

This is a continuation application of International Application Number PCT/SE99/02005 filed Nov. 5, 1999 which designates the United States. The disclosure of that application is expressly incorporated herein by reference.

BACKGROUND OF INVENTION

1. Technical Field

The present invention relates to a method and a device for chill molding cast iron.

A method and a device for the manufacture of cast iron parts by casting in a stationary metal mold, which is lined with a layer of hardening molding material or green sand, is shown in SE-C-506508. In that arrangement, a tubular metal mold is used whereby a tubular, upwardly open space in the mold is lined using an insulating form material. Molten cast iron is filled from above in such a way that the cooling effect of the mold and lining gives a directional frontage of solidification from the lower end of the lining and upwards to a feeder volume at the top for the last of the iron to solidify.

The described method and device give excellent results for cast parts of even thickness and relatively thin walls, such as cylinder linings, but are less suitable for casting of parts with varying cross-section and more complex geometry, where the rate of cooling will vary too much between different parts of the casting. Demands for improved mechanical properties combined with good ductility means that alloyed materials, which are traditionally used for improving mechanical properties, can not be used as the workability will be reduced due to the high carbide content and casting becomes difficult due to its tendency to shrink.

SUMMARY OF INVENTION

A general purpose of the present invention is to provide a method and a device for chill molding cast iron parts of varying cross-sectional area and of relatively complex geometry in which the mechanical properties of the cast material is not controlled and limited by the added alloying materials alone.

A further purpose of the casting method according to the invention is to provide increased possibilities for influencing the rate of cooling of the casting, primarily through the pearlite transformation temperature range, which makes it possible to improve the mechanical properties even further. An increased rate of cooling will also increase productivity; that is, a larger number of cast parts per unit of time and production unit.

Still further, the invention fulfills and/or enables: high level environmental requirements such as low emissions of pollutants, reduced use of energy, a clean working environment, reduced use of molding material or sand, calculated per unit of weight for castings with a corresponding reduced need for depositing molding material or sand, and a significantly improved recovery of added energy.

According to the present invention, these purposes are achieved by a device for casting cast iron that includes a chill mold having outer walls and inner walls in which the inner walls are in contact with a mold. The device also includes pressurizing means or arrangements for applying a variable pressure against the outer walls of the mold. A chill mold cooling means or mechanism for variable cooling of the inner walls of said metal chill mold is also provided.

The wall thickness of the mold is chosen so that the desired rate of heat transfer for the required mechanical properties of the cast part is achieved. The mold is preferably made of molding material or green sand.

Furthermore, it is advantageous to include an hydraulic or a pneumatic press in the pressurizing means or mechanism for acting on the outer walls of the metal chill mold.

The chill mold cooling means or mechanism preferably includes a number of cooling circuits arranged in the metal chill mold, a coolant container, a heat exchanger and a coolant pump that circulates a coolant through a coolant conduit interconnecting the cooling circuits with the coolant container, the heat exchanger and the coolant pump.

These purposes are achieved according to the present invention by a method for manufacturing cast iron parts in which a metal chill mold, having outer walls and inner walls and where the inner walls are in contact with a mold, is filled with molten cast iron. The method is characterized in that pressurizing means or mechanism can apply a variable pressure against the outer walls of the metal chill mold and the chill mold cooling means can variably cool the inner walls of the metal chill mold during the cooling of the casting.

The mold is preferably made from a hardening molding material or green sand. The thickness of the walls of the mold is chosen to achieve the required rate of cooling.

The casting method allows casting of materials having a low C-equivalent, as well as materials having high levels of carbide stabilizing alloying materials to be used to obtain castings with a considerably higher flexural strength, fatigue strength and modulus of elasticity, which in all will give good mechanical properties.

By casting materials with a low C-equivalent and by adding moderate amounts of carbide stabilizing alloying materials, a strong material, virtually free of carbides and with a good machinability, can be obtained.

The casting method will also give less dimensional scatter for the casting compared to conventional green sand casting.

BRIEF DESCRIPTION OF DRAWINGS

Preferred embodiments of the invention will be described in more detail below, with reference to the appended figure, wherein.

DETAILED DESCRIPTION

Figure 1:
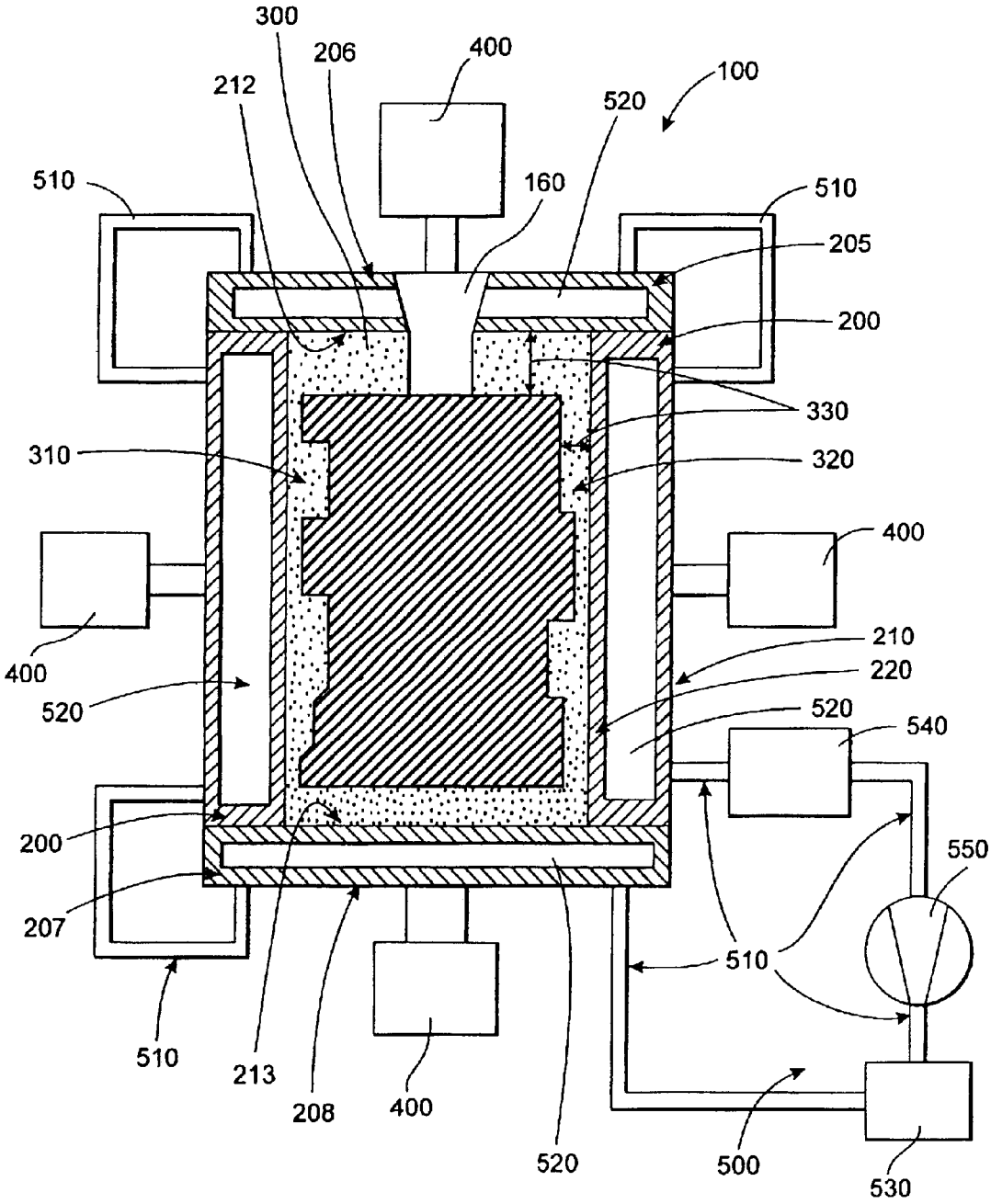
FIG. 1 shows a schematic cross-section of a device for chill mold casting of cast iron according to the present invention.

FIG. 1 shows an arrangement for chill mold casting a cast iron article according to the present invention. The device includes a rigid, thick-walled metal chill mold 100, with side elements 200, a top element 205 and a bottom element 207. Each of the side elements 200 has an outer wall 210, facing away from a mold cavity 150 and into which molten cast iron is to be poured, and an inner wall 220 that faces the mold 300. The top element 205 is provided with a corresponding outer side 206 and an inner side 212.

The bottom element 207 has an outer side 208 and an inner side 213. The thickness of he mold wall 330 is chosen so that a desired heat transfer rate is obtained. The mold material, wall thickness, pressure and temperature controls the heat transfer rate; that is, a thin wall will give a fast cooling rate and a thick wall a slow cooling rate. The mold 300 is produced by conventional methods, alternatively in a air-squeezing core machine, a core forming machine or by manual manufacture, using a hardening, insulating mold material, with a suitable known organic or inorganic binding agent, or green sand. The molding is performed using a template which shapes the mold cavity 150. The thickness of the mold wall 330 is typically generated by conventional means, but may alternatively be established in the core box or by the height of the mold block.

The mold 300 preferably includes a first mold part 310 and a second mold part 320. The mold parts 310 and 320 are joined by means of an adhesive or a bolt connection after the core has been assembled, should a core be required. The mold 300 is placed in the chill mold 100 whereupon the side elements 200, the top element 205 and the bottom element 207 of the chill mold 100 closes around the mold 300 by pressurizing one or more pressurizing means or mechanisms 400. Molten material is poured into the mold through an inlet port 160 which is connected to the mold cavity 150. The inlet port is made by conventional methods.

In this way it is possible to apply variable pressure on the side elements 200, the top element 205 and the bottom element 207 of the chill mold, using pressurizing means 400 arranged in connection with the chill mold. The pressurizing means 400 preferably includes hydraulic or pneumatic presses arranged to act on the outer walls, 206, 208 and 210 respectively, of the chill mold. During solidification of the molten material in the chill mold 100, volume reductions (e.g. during forming of austenite) and increases (e.g. during forming of graphite) will occur during different phase transformations. These changes in volume will be larger or smaller depending on factors such as the relationship in size between the molten material, the mold and cores, if any, as well as the chemical composition of the basic material, inoculation, treatment of the smelt, etc. By making it possible to control the pressure applied to the outer walls, 206, 208 and 210 respectively, of the chill mold, it is also possible to partially control the force by which residual molten material is transferred from areas of increasing volume to areas of decreasing volume, without being forced into the mold or core, nor causing shrinkage porosity.

The device according to the invention is also provided with variable cooling by a chill mold cooling means or mechanism 500 with acts on the inner walls of the chill mold 212, 213 and 220 respectively. The chill mold cooling means 500 includes several, preferably six, cooling circuits 520 arranged in or on the side elements 200, top element 205 and bottom element 207 of the chill mold. The chill mold cooling means 500 preferably includes a coolant container 530 in which a coolant such as water is stored. A heat exchanger 540 is included for recovering heat from the coolant and a coolant pump 550 is used for circulating the coolant through a coolant conduit to and from the coolant circuits 520.

The mold cavity 150 is cooled by the coolant in the chill mold 100 during the entire casting process. The rate of cooling is regulated by the heat transfer rate of the mold wall 330, the heat transfer rate of the inner wall 220 of the chill mold, the mold cavity 150 and the temperature of the coolant. The heat transfer is also affected by the pressurization of the pressurizing means 400. The rate of cooling is controlled during the entire cooling process, until the pearlite transformation has been completed, to achieve the desired mechanical properties for the casting; a high cooling rate will give a high strength. The cooling rate through the pearlite transformation phase can be increased by opening the chill mold when the temperature of the casting is above the temperature for pearlite transformation. The air cooling which will then occur increases the cooling rate further giving an even higher strength. On the other hand, the cooling rate can also be reduced by opening the chill mold when the temperature of the casting is in the austenite range. Immediately after the opening, the casting is immersed in and covered by an insulating medium and is kept in this state until the temperature of the casting has dropped below the pearlite transformation temperature. This method can also be used for reducing stresses in the cast part, but the casting must then be kept in the insulating medium until its temperature is lower than 200° C., in the case of cast iron. The opening of the chill mold can take place before or after the pearlite transformation phase, depending on the material properties desired.

The invention is not limited to the embodiments shown in the figure or described above, but can be modified within the scope of the appended claims. It is, for instance, possible to construct the mold in more than two mold parts, e.g. by using three or four parts assembled into one mold unit.

What is claimed is:

1. A device for casting cast iron, said device comprising a metal chill mold having outer walls and inner walls, which inner walls are in contact with a mold and wherein said device further includes pressurizing means for applying a variable pressure on the outer walls of the chill mold and chill mold cooling means for variable cooling of the inner walls of said chill mold.

2. The device according to claim 1, wherein said pressurizing means includes hydraulic or pneumatic presses arranged to act on the outer walls of said chill mold.

3. The device according to claim 1, wherein said chill mold cooling means includes several cooling circuits arranged in said chill mold, a coolant container, a heat exchanger and a coolant pump, whereby said coolant pump circulates a coolant through a coolant conduit connecting said coolant circuits with each other and with said coolant container, said heat exchanger and said coolant pump.

4. The device according to claim 1, wherein the wall of said mold has a thickness chosen so that a desired rate of heat transfer is obtained, in order to achieve desired mechanical properties in the cast material.

5. The device according to claim 1, wherein said mold is made of a hardening mold material or green sand.

6. A method for making iron castings by means of a metal chill mold having outer walls and inner walls, said inner wall being in contact with a mold, the method comprising the steps of:

filling the mold with molten cast iron, applying variable pressure with a pressuring means on the outer walls of said metal chill mold, and variably cooling with a chill mold cooling means the inner walls of said chill mold during cooling of the casting.

7. The method according to claim 6, wherein said mold is made of a material which is selected from the group consisting of a hardening mold material and green sand.

8. The method according to claim 6, said pressurizing means further comprises hydraulic or pneumatic presses, the method further comprising the step of arranging said hydraulic or pneumatic presses so as to act on the outer walls of said chill mold.

9. The method according to claim 6, wherein said chill mold cooling means further comprises one or more cooling circuits arranged in said chill mold, a coolant container, a heat exchanger and a coolant pump, the method further comprising the step of:

circulating a coolant by means of said coolant pump through a coolant conduit connecting said one or more coolant circuits with each other and with said coolant container, said heat exchanger and said coolant pump.

10. The method according to claim 6, further comprising the step of choosing the thickness of the wall of said mold so that a desired rate of cooling of the casting is obtained.

11. An arrangement for casting cast iron articles, said arrangement comprising:

a metal chill mold having an outer wall and an inner wall, said inner wall configured to contact an article being molded therein;

a pressurizing mechanism configured to apply variable pressure on said outer wall of said chill mold; and a chill mold cooling mechanism configured to variably cool said inner wall of said chill mold.

12. The arrangement according to claim 11, further comprising:

said pressurizing mechanism including an hydraulic press arranged to act on said outer wall of said chill mold.

13. The arrangement according to claim 11, further comprising:

said pressurizing mechanism including a pneumatic press arranged to act on said outer wall of said chill mold.

14. The arrangement according to claim 11, further comprising:

a plurality of cooling circuits arranged in said chill mold and said cooling circuits being interconnected by a coolant conduit;

a coolant container;

a heat exchanger; and a coolant pump, said coolant pump configured to circulate coolant through said coolant conduit and said cool circuits, said coolant container, said heat exchanger and said coolant pump.

15. The arrangement according to claim 11, further comprising:

each of said walls of said mold having a respective thickness chosen so that a desired rate of heat transfer is obtained in order to achieve desired mechanical properties in the cast material.

16. The arrangement according to claim 11, further comprising:

said mold is constructed of hardening mold material.

17. The arrangement according to claim 11, further comprising:

said mold is constructed of green sand.

* * * * *